US006892919B2

(12) United States Patent
Higuchi et al.

(10) Patent No.: US 6,892,919 B2
(45) Date of Patent: May 17, 2005

(54) STAPLE DETECTION MECHANISM OF ELECTRIC STAPLER

(75) Inventors: Kazuo Higuchi, Tokyo (JP); Katsuya Hakozaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/487,260

(22) PCT Filed: Aug. 22, 2002

(86) PCT No.: PCT/JP02/08482

§ 371 (c)(1),
(2), (4) Date: Feb. 20, 2004

(87) PCT Pub. No.: WO03/018268

PCT Pub. Date: Mar. 6, 2003

(65) Prior Publication Data

US 2004/0195288 A1 Oct. 7, 2004

(30) Foreign Application Priority Data

Aug. 23, 2001 (JP) ..... P.2001-253528

(51) Int. Cl.[7] ..... B25C 5/16

(52) U.S. Cl. ..... 227/2; 227/131; 227/136; 227/155

(58) Field of Search ..... 227/2, 5, 131, 227/120, 155, 135, 136, 82, 83, 85, 88

(56) References Cited

U.S. PATENT DOCUMENTS 4,623,082 A * 11/1986 Kurosawa ..... 227/7
4,770,334 A * 9/1988 Hoshi et al. ..... 227/85
5,230,457 A * 7/1993 Hiroi et al. ..... 227/2
5,269,503 A * 12/1993 Hiroi et al. ..... 270/58.09
5,535,937 A * 7/1996 Boiarski et al. ..... 227/175.3
5,660,314 A * 8/1997 Magnusson et al. ..... 227/2
5,702,047 A * 12/1997 Yoshie ..... 227/131
6,050,471 A * 4/2000 Yagi ..... 227/119
6,371,352 B1 * 4/2002 Mochizuki ..... 227/155
6,474,633 B1 * 11/2002 Hirai ..... 270/58.09
6,715,654 B2 * 4/2004 Sugihara et al. ..... 227/2

FOREIGN PATENT DOCUMENTS

JP 41-266 Y2 1/1966
JP 4-54682 U 5/1992

* cited by examiner

*Primary Examiner*—Scott A. Smith
(74) *Attorney, Agent, or Firm*—Morgan, Lewis & Bockius LLP

(57) ABSTRACT

In an electric stapler which includes: a passage (4) formed in a magazine portion (2) of the stapler body (1), for attaching and detaching a staple cartridge (3); and sheet staples (a) accommodated in the staple cartridge (3), wherein both side portions of the lead staple (a1) and the following staples of the sheet staples (a) are successively bent and stricken, a staple detection sensor (7), both sides of the end of the actuator (8) of are tapered, is arranged so that both side portions can be directed to an entrance of the passage (4) and the end of the staple detection sensor (7) can be engaged with an upper or a lower face of the sheet staples (a) of the staple cartridge (3) attached into the passage (4). The actuator (8) is swung and tilted in the perpendicular direction to the longitudinal direction of the passage (4) and biased by a spring so that it can obliquely rise at all times.

3 Claims, 6 Drawing Sheets

STAPLE DETECTION MECHANISM OF ELECTRIC STAPLER

TECHNICAL FIELD

The present invention relates to a mechanism of detecting the presence of staples, which are accommodated in a staple cartridge, in an electric stapler.

BACKGROUND ART

In general, the following electric stapler is well known. Sheet staples composed of a large number of linear staples, which are connected with each other being formed into a sheet-shape, are accommodated in a staple cartridge. This staple cartridge is mounted in a passage, which is formed in a magazine portion of the stapler body, used for attaching the cartridge. After the staple cartridge has been inserted and mounted, a staple at the lead of the sheet staples is stricken out while both sides of the staple are being bent, and the following staples are successively stricken out while both sides of the staples are being bent. In this type electric stapler, when a quantity of residual sheet staples in the staple cartridge are decreased, it is necessary to pick up the cartridge from the magazine portion and replace it with a new cartridge. Therefore, it is necessary to provide a staple detecting sensor for detecting the quantity of residual sheet staples in the staple cartridge.

However, a space of the passage provided in the stapler body, to which the staple cartridge is attached, is small. Therefore, even when a common microswitch is attached into the space, a stroke of the switch is too short. Accordingly, the microswitch is operated even when the staple cartridge is moved a little. For example, even when a sufficiently large quantity of staples are left in the cartridge, when the sheet staples are deformed being badly warped, the actuator of the microswitch comes into action. Therefore, the reliability of detection is unavoidably deteriorated. In the case where the microswitch is arranged in the passage, when the actuator is arranged making a right angle with the passage, it obstructs the attaching and detaching work of the staple cartridge. Accordingly, it is necessary to provide a mechanism to prevent the actuator from protruding into the passage in the case of inserting the staple cartridge, which increases the difficulties of arranging the microswitch in the staple cartridge attaching passage. Further, when the sensor is arranged at a position close to the introducing port of the staple cartridge, at the time of inserting the staple cartridge, the staple cartridge is inclined with respect to the passage. Therefore, when the cartridge is attached or detached, the staple cartridge is hooked at the actuator, which causes damage to both the staple cartridge and the actuator. In order to solve this problem, it is necessary to provide a big margin of relief of the actuator.

As described above, it is very difficult to arrange the common microswitch in the stapler body having only a small space.

SUMMARY OF THE INVENTION

The present invention has been accomplished to solve the above problems. It is an object of the present invention to provide a mechanism of detecting staples in an electric stapler by which a quantity of residual staples can be positively detected even when a space, in which the mechanism is arranged, is small, when a profile and mode of operation of the actuator are improved.

In order to solve the above problems, the present invention provides a mechanism of detecting staples in an electric stapler. The electric stapler is composed as follows. A passage for attaching a staple cartridge is formed in a magazine portion of the stapler body. In the staple cartridge, sheet staples, in which a large number of linear staples are connected to each other being formed into a sheet-shape, are accommodated. Both sides of the lead staple and the following staples of the sheet staples are successively bent and stricken out by the electric stapler. In this electric stapler, the mechanism of detecting staples is composed as follows. A staple detection sensor, both side portions of the end of the actuator of which are tapered, is arranged so that both the side portions can be directed to an entrance of the passage and the end of the actuator can be engaged with an upper or a lower face of the sheet staples of the staple cartridge attached into the passage. The actuator is attached so that the actuator can be swung and tilted in the perpendicular direction to the longitudinal direction of the passage, and the actuator is biased by a spring so that it can be raised obliquely at all times.

Figure 1:
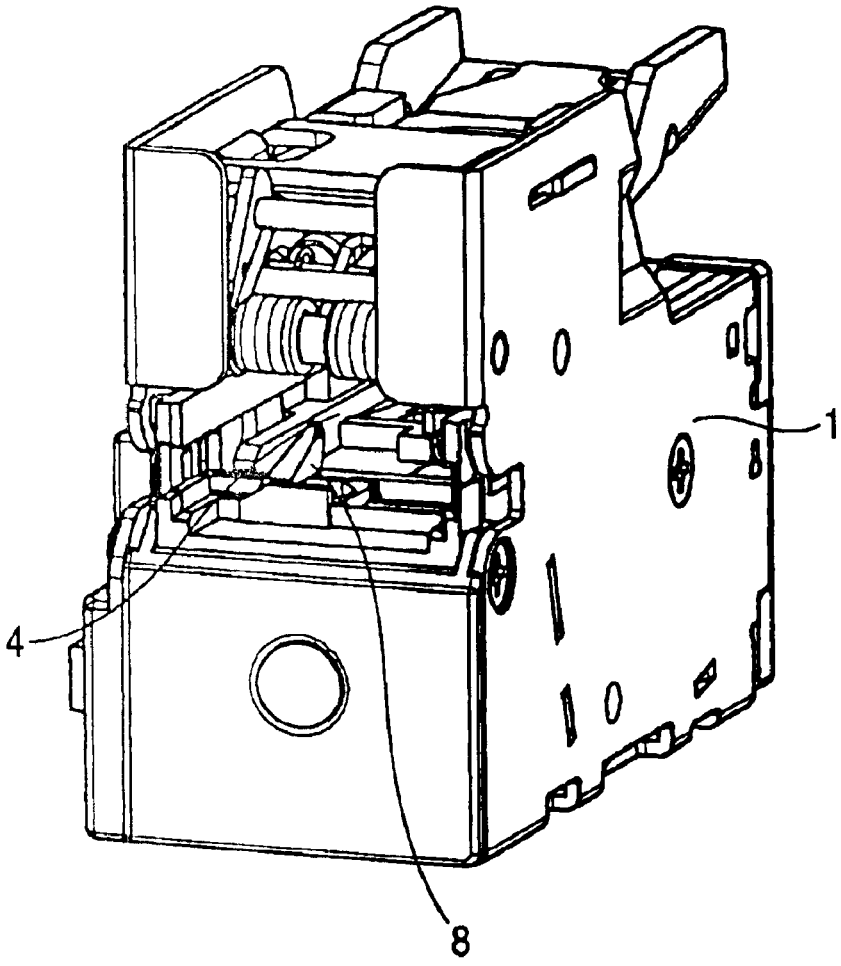
FIG. 1 is a perspective view of the stapler body of the electric stapler.

Note that in the drawings, reference numeral 1 is a stapler body, reference numeral 3 is a staple cartridge, reference numeral 4 is a passage and reference numeral 8 is an actuator.

DESCRIPTION OF THE PREFERRED EMBODIMENTS

Figure 2:
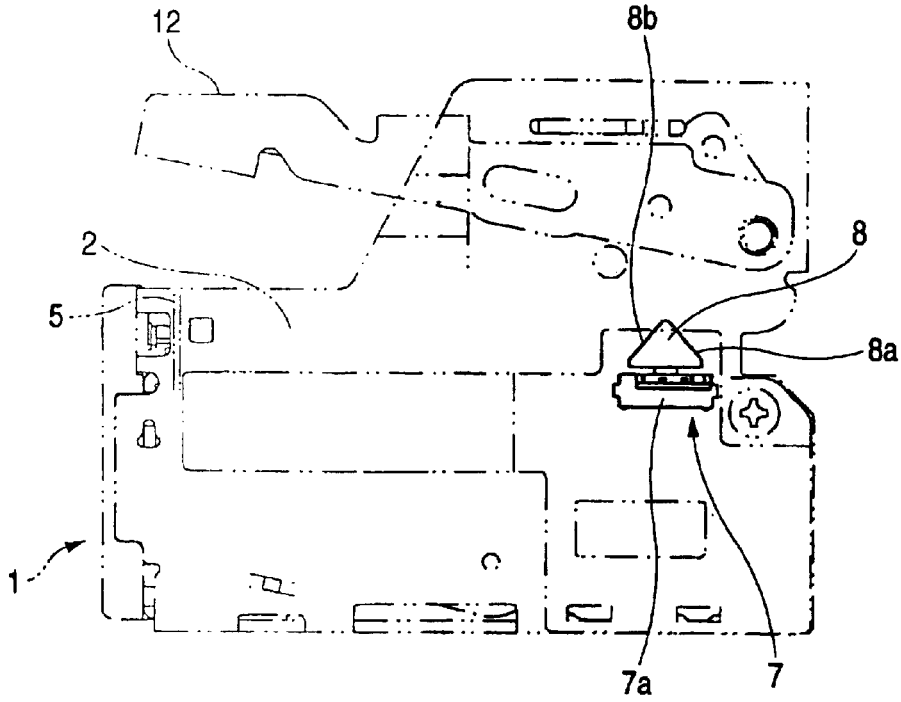
FIG. 2 is a simplified view of the side of the stapler body of the electric stapler.
Figure 3:
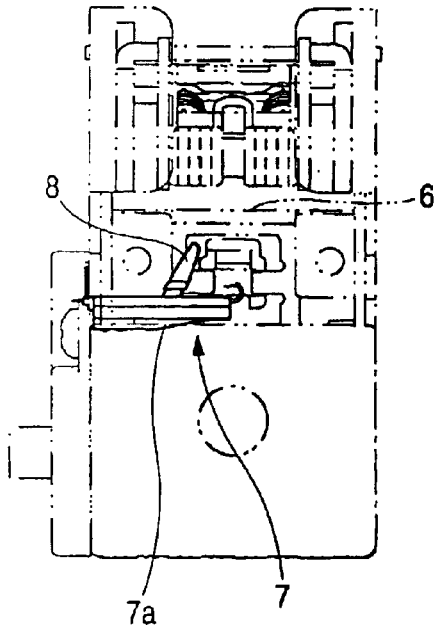
FIG. 3 is a rear view of the stapler body of the electric stapler.

FIG. 1 is a perspective view of the stapler body of the electric stapler, FIG. 2 is a simplified view of the side of the stapler body of the electric stapler and FIG. 3 is a rear view of the stapler body of the electric stapler.

Figure 4:
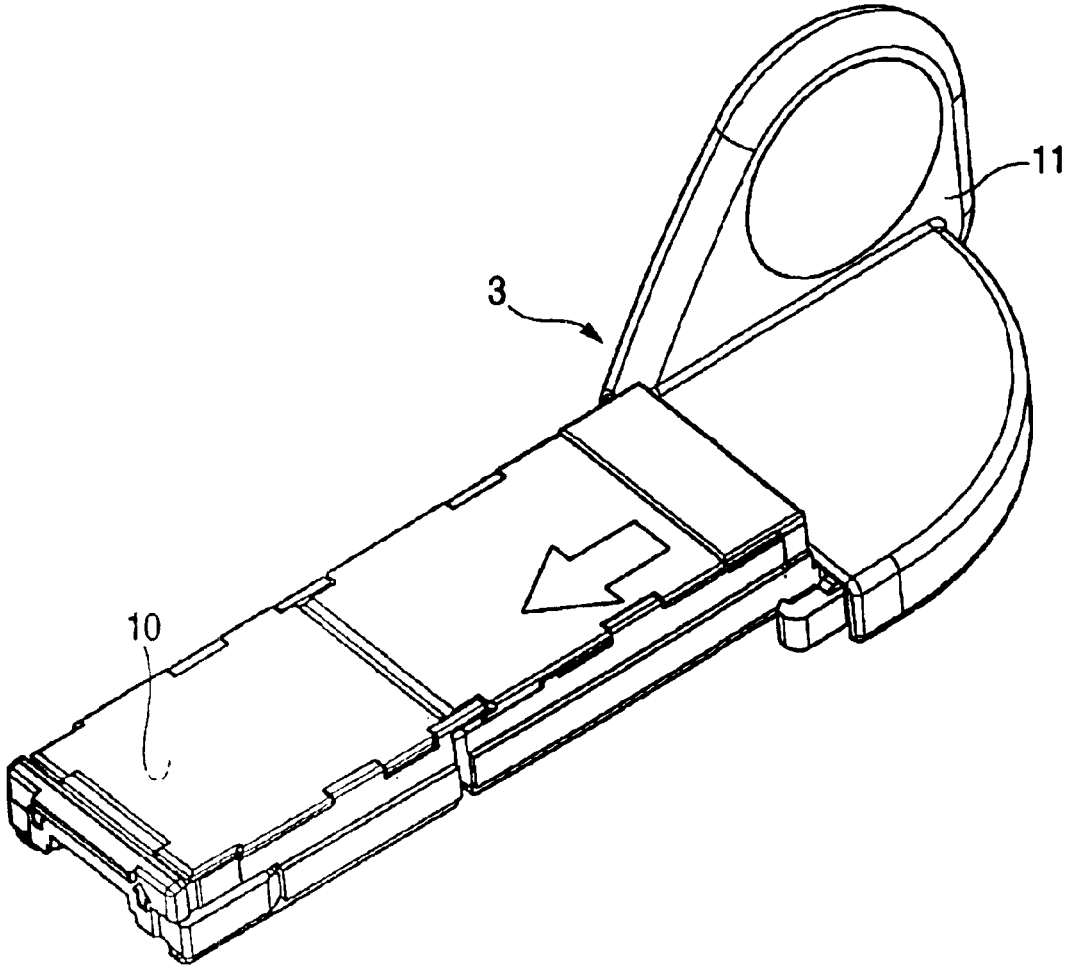
FIG. 4 is a perspective view of the staple cartridge, wherein the view is taken from an upper face.
Figure 5:
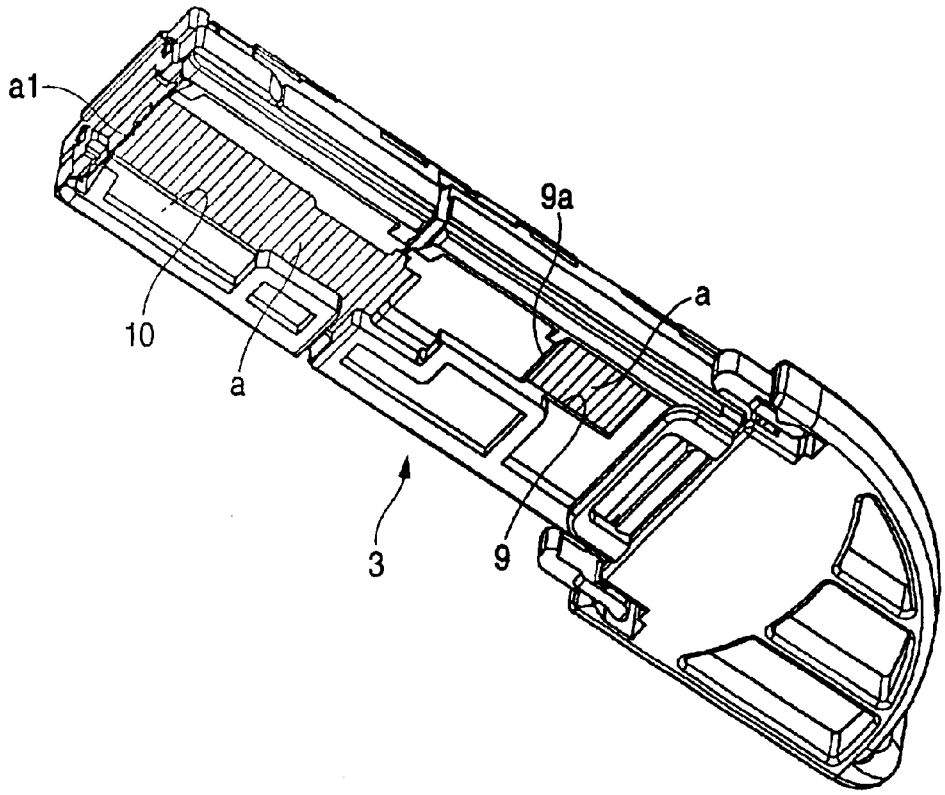
FIG. 5 is a perspective view of the staple cartridge, wherein the view is taken from a lower face.
Figure 6:
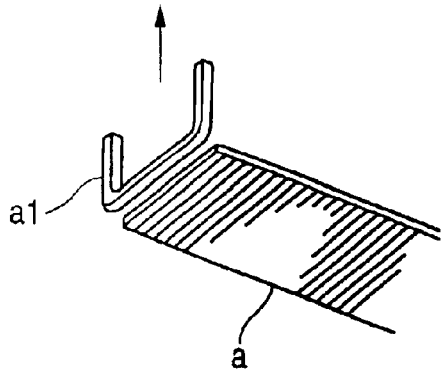
FIG. 6 is a partial perspective view of the sheet staples.

In the above electric stapler, the staple cartridge 3 shown in FIGS. 4 and 5 is detachably attached to the magazine portion 2 of the stapler body 1. In the staple cartridge 3, a plurality of stages of sheet staples "a" (shown in FIG. 6), in which a large number of linear staples are connected with each other being formed into a sheet-shape as shown in FIG. 6, are stacked and accommodated. In the magazine portion 2 of the stapler body 1, the passage 4 for attaching the cartridge is formed. The above staple cartridge is inserted and attached into the above passage 4. After the staple cartridge 3 has been attached, the driver plate 5 provided in the stapler body 1 is driven upward, and a staple at the lead of the sheet staples "a" is made to penetrate sheets of paper to be stapled. Further, the upper arm 12 is driven downward so that both sides of the staple, which has penetrated the sheets of paper to be stapled, are bent. After the completion of biding the sheets of paper, the driver plate 5 and the arm 12 are respectively descended and ascended to the initial position, and the sheet staples are fed forward by a feeding means (not shown) so as to prepare for the next binding operation. The aforementioned operation is repeated, and both sides of the staples are successively bent and stricken out. In this connection, the mechanism of bending both sides of the lead staple and striking the staple is well known. Therefore, the explanations are omitted here.

Next, the sensor 7 for detecting the staple is arranged in the neighborhood on the cartridge introducing portion side of the passage 4 of the above magazine portion 2.

In this sensor 7, the switch is turned on and off when the actuator 8 provided in the switch body 7*a* is operated. Both sides 8*a,* 8*b* of the end portion of the actuator 8 are tapered. In this way, the actuator 8 is formed into a triangular-plate-shape or trapezoidal-plate-shape. The actuator 8 is attached so that it can be tilted with respect to the switch body 7*a*. The tilting direction is perpendicular to the face of the actuator 8. When the actuator 8 rises, it is a little inclined with respect to the perpendicular direction. The actuator 8 is biased by a spring not shown so that it can rise at all times.

Next, the detection sensor 7 is arranged in the neighborhood of the cartridge 3 introducing portion side (the entrance side) of the passage 4. At this time, the staple detection sensor 7 is attached so that both sides 8*a,* 8*b* described above can be directed to the entrance of the passage 4. At this time, the actuator 8 protrudes into the passage 4.

As shown in FIGS. 4 and 5, the guide passage 10 of the sheet staples "a" and the knob 11 are provided in the staple cartridge 3. On the lower face of the guide passage 10, the opening 9 is formed at the rear portion corresponding to the detection sensor 7 when the staple cartridge 3 is inserted into the magazine portion 2 of the stapler body 1, that is, at the position on the knob side. The lower face of the sheet staples "a", which are provided inside, is exposed from this opening 9.

Figure 7:
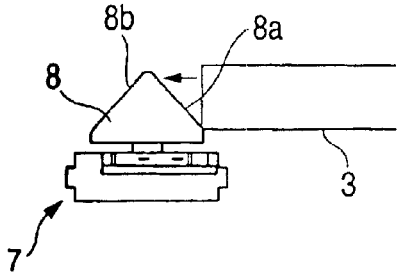
FIG. 7(*a*) and FIG. 7(*b*) are a schematic illustration showing a state in which the staple cartridge collides with the detection sensor, wherein the illustration is taken from the side, and a schematic illustration showing a state in which the staple cartridge is attached, wherein the illustration is taken from the rear side.
Figure 7:
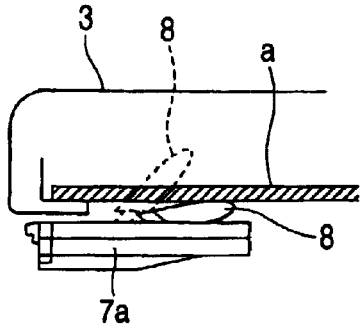
Figure 8:
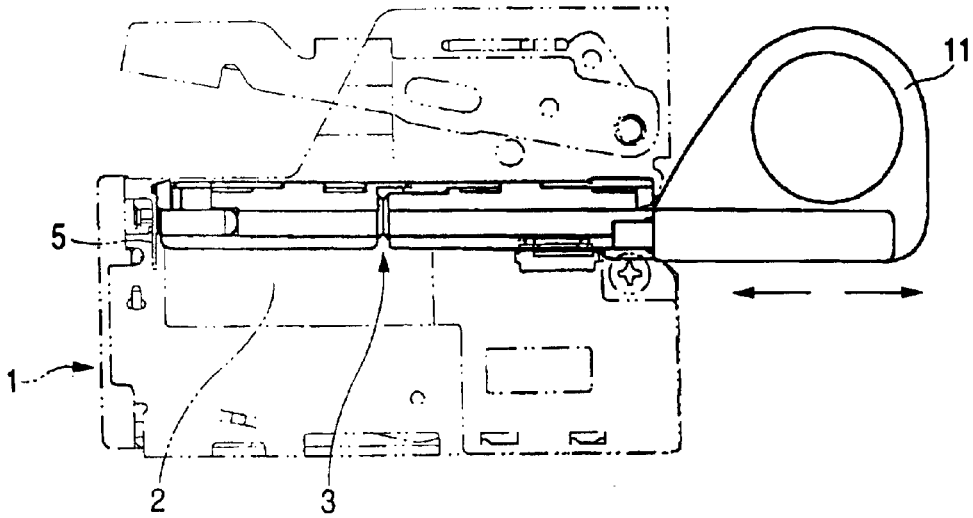
FIG. 8 is a side view showing an outline of the state in which the staple cartridge is attached to the stapler body.
Figure 9:
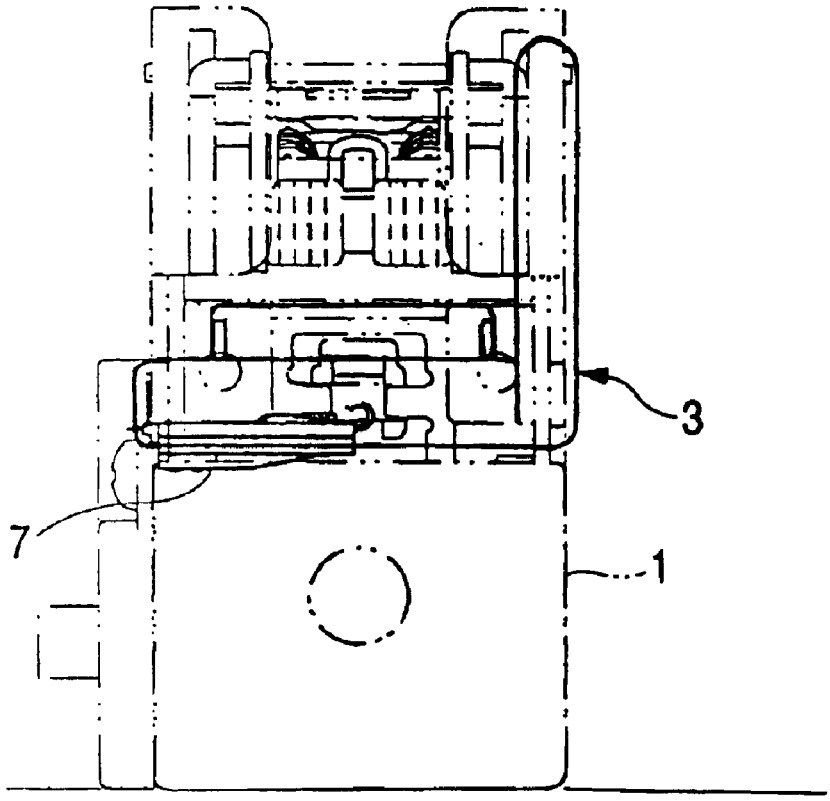
FIG. 9 is a rear view showing an outline of the state in which the staple cartridge is attached to the stapler body.

When the cartridge 3 is inserted into the passage 4 of the stapler body 1, since the actuator 8 of the staple detection sensor 7 protrudes into the passage 4, as shown in FIG. 7(*a*), the forward end portion of the staple cartridge 3 comes into contact with the inclined side portion 8*a* on the rear side of the actuator 8 so that the actuator 8 can be pushed by the forward end portion of the staple cartridge 3. Since the actuator 8 rises obliquely, when the inclined side portion 8*a* is pushed, the actuator 8 is swung and tilted in the perpendicular direction with respect to the longitudinal direction of the passage 4 as shown in FIG. 7(*b*). FIG. 8 is a side view showing a state in which the staple cartridge 3 is attached, and FIG. 9 is a rear view showing a state in which the staple cartridge 3 is attached. When the staple cartridge 3 is attached at a predetermined position, the actuator 8 proceeds into the cartridge 3 from the opening 9, which is formed in the lower portion of the staple cartridge 3, by a force of the spring. However, the actuator 8 is engaged with the lower face of the sheet staples "a", which are accommodated in the cartridge 3, and tilted as shown in FIG. 7(*b*). This tilting state of the actuator 8 is maintained.

After the staple cartridge 3 has been attached, when the driver plate 5 provided in the stapler body 1 is driven upward and downward, the staple "a1" at the lead of the sheet staples "a" is successively stricken out while both sides of the staple are being bent. Then, the staples "a" in the staple cartridge 3 are consumed little by little. When a quantity of the residual staples "a" are reduced and the trailing end of the last sheet staple "a" passes through the staple detection sensor 7, the actuator 8 is released. Therefore, as shown by the dotted line in FIG. 7(*b*), the actuator 8 is swung by the spring force and rises obliquely. Due to the above operation, it can be detected that the staples "a1" have been used up. Therefore, the staple cartridge 3 may be pulled out in the opposite direction to the inserting direction and replaced with a new staple cartridge 3. In the case of pulling out the staple cartridge 3, the edge 9*a* (shown in FIG. 5) of the opening 9 of the staple cartridge 3 comes into contact with and pushes the inclined side portion 8*b* of the front side of the actuator 8. Since the actuator 8 obliquely rises, when the inclined side portion 8*b* is pushed, the actuator 8 is swung and tilted resisting the spring force. Therefore, the actuator 8 does not obstruct the insertion of the staple cartridge 3. Accordingly, the staple cartridge 3 can be smoothly and positively attached to and detached from the stapler.

In this connection, in the above example, a plurality of stages of sheet staples are stacked in the staple cartridge 3 and the thus stacked sheet staples are successively consumed from the upper stage. However, according to another example, the stacked sheet staples are successively consumed from the lower stage. Further, according to still another example, long sheet staples are spirally accommodated in the staple cartridge. In this case, the staple detection sensor may be, arranged on the upper side of the passage, and the actuator may be composed so that it can protrude from top to bottom.

In this connection, it should be noted that the present invention is not limited to the above specific embodiment, and variations may be made without departing from the scope and spirit of the present invention. Of course, the variations are included in the present invention.

This application is based on the Japanese Patent Application (Patent Application No. 2001-253528) applied on Aug. 23, 2001. The contents of these applications are taken in here as a reference.

INDUSTRIAL APPLICABILITY

As described above, the actuator 8 of the above detection sensor is not protruded to and retracted from the passage 4 under the condition that it rises perpendicularly, but the detection sensor is tilted with respect to the passage 4. Therefore, the operation stroke of the actuator 8 is extended. Accordingly, even when a space of the passage 4 is small, no malfunction of the actuator 8 is caused, and the presence of staples can be positively detected. Therefore, the reliability of detection is high.

Since the actuator is composed in such a manner that both side portions 8*a,* 8*b* of the end portion of the actuator are tapered and the actuator can be freely tilted, and when the actuator collides with the staple cartridge 3, it can move so as to escape from the staple cartridge 3. Therefore, the actuator 3 does not obstruct the attaching work of the staple cartridge 3. Accordingly, a big relief margin of the actuator 8 is not required.

What is claimed is:

1. A mechanism of detecting staples for an electric stapler, the electric stapler including: a staple cartridge; a passage formed in a magazine portion of a stapler body, for attaching and detaching the staple cartridge; and sheet staples composed of a large number of linear staples, which are connected with each other being formed into a sheet-shape, accommodated in the staple cartridge, wherein both sides of the lead staple and the following staples of the sheet staples are successively bent and stricken out by the electric stapler, comprising:

an actuator having both side portions which are formed being tapered; and a staple detection sensor operated by the actuator, wherein said both side portions of the actuator are directed toward an entrance of the passage, an end of the actuator is arranged so that it can be engaged with an upper or a low face of the sheet staples accommodated in the staple cartridge attached into the passage, and the actuator is attached so that it can be tilted in the perpendicular direction to the longitudinal direction of the passage when the actuator is swung, and the actuator is biased by a spring so that it can be raised obliquely.

2. The mechanism of detecting staples for an electric stapler according to claim 1, wherein the actuator is formed into a triangular-plate-shape.

3. The mechanism of detecting staples for an electric stapler according to claim 1, wherein the actuator is formed into a trapezoidal-plate-shape.

* * * * *